US005148584A

United States Patent [19]

Fehrer

[11] Patent Number: 5,148,584

[45] Date of Patent: Sep. 22, 1992

[54] APPARATUS FOR NEEDLING A NONWOVEN WEB

[76] Inventor: Ernst Fehrer, Auf der Gugl 28, A-4020 Linz, Austria

[21] Appl. No.: 698,460

[22] Filed: May 10, 1991

[30] Foreign Application Priority Data

May 16, 1990 [AT] Austria ..... 1087/90
Jul. 31, 1990 [AT] Austria ..... 1606/90
Dec. 11, 1990 [AT] Austria ..... 2507/90

[51] Int. Cl.[5] ..... D04H 18/00
[52] U.S. Cl. ..... 28/115
[58] Field of Search ..... 28/107, 108, 109, 110, 28/111, 115, 113, 114; 156/148

[56] References Cited

U.S. PATENT DOCUMENTS 84,325 11/1968 Waring ..... 28/115
2,385,870 10/1945 Lashar et al. ..... 28/107
3,199,166 8/1965 Petersik ..... 28/107
3,397,436 8/1968 Zocher ..... 28/115
3,485,709 12/1969 Evans et al. ..... 28/108

FOREIGN PATENT DOCUMENTS 267895 1/1969 Austria ..... 28/107
2138069 12/1972 France .
1327993 4/1971 United Kingdom .

*Primary Examiner*—Werner H. Schroeder
*Assistant Examiner*—Amy Brooke Vanatta
*Attorney, Agent, or Firm*—Collard & Roe

[57] ABSTRACT

In order to produce a needled nonwoven web having an improved surface quality, the needle board (1) of an apparatus for needling a nonwoven web should be provided with needles in a higher needle density. To that end the needles (2) of the needle board (1) are arranged in groups having a higher needle density and a perforated plate (5) of the stripper (4) and a perforated plate of the backing member (3) are provided in association with each group of needles with a common receiving hole (7). The needles (2) of each group are arranged in a longitudinal row generally extending in the direction of travel of the nonwoven web and are transversely offset from each other.

7 Claims, 2 Drawing Sheets

APPARATUS FOR NEEDLING A NONWOVEN WEB

BACKGROUND OF THE INVENTION

1. Field of the Invention

This invention relates to an apparatus for needling a nonwoven web comprising at least one needle board provided with a multiplicity of needles, a backing member facing the needle board and spaced therefrom, and a stripper, which is disposed between the backing member and the needle board, wherein said stripper and optionally also the backing member comprises a perforated plate that is formed with holes, the needles are movable through said holes and are arranged in groups, and a hole in the perforated plate of the stripper and a hole in the optional perforated plate of the backing member is commonly associated with the needles of each of said groups.

2. Description of the Prior Art

To ensure that a nonwoven web will be uniformly needled, a uniform distribution of the needle penetrations over the width of the nonwoven web is desired. For this reason the pitch of the needles in the direction of the working width of the needling apparatus is uniform and the pitch of the holes in the perforated plate of the stripper and the pitch of the holes of any perforated plate of the backing member in said direction is uniform too and is equal to said needle pitch. For that purpose the needles and the holes associated with respective needles formed in the perforated plate and associated with respective needles are arranged in uniformly spaced apart transverse rows and have a uniform pitch in each of said rows. The spacing of said transverse rows and the hole pitch in each of said transverse rows are selected to provide for a hole spacing in excess of a minimum hole spacing required for structural reasons. The rows of holes are staggered relative to each other. Whereas such an arrangement will provide a uniform pitch of the needles in the direction of the working width, the occurrence of surface textures which visibly disturb the appearance of the surface of the needled webs, particularly in larger areas, cannot be precluded thereby.

If the individual needles are not mounted in the needle board in respective bores in the needle board but groups of needles are mounted either in a common bore in the needle board or in a common shank holder, which is mounted like a single needle in a bore in the needle board (British Patent Specification 1,327,993; French Patent Specification 2,138,069), and if the perforated plate of the stripper and any perforated plate of the backing member is formed with holes associated each with the commonly held needles, it will be possible to achieve a locally increased needle density. But the problem to avoid a surface structure in the nonwoven web will not be solved thereby because the bores provided in the needle board for receiving the shanks of respective groups of needles are again uniformly distributed. Besides, the needles contact each other in part so that the needle pitch in each group of needles is very small and the gaps between the needles may become clogged with fibers.

SUMMARY OF THE INVENTION

For this reason it is an object of the invention so to improve an apparatus which is of the kind described first hereinbefore with simple means that the apparatus can be used to make needled nonwoven webs which have a substantially unstructured surface.

That object is accomplished in accordance with the invention in that each needle is held in a separate bore in the needle board and the needles of each group are arranged in at least one longitudinal row that extends generally in the direction of travel of the nonwoven web and are transversely offset from each other in said row.

The surface of the needled nonwoven web will depend not only on the number of needle penetrations per unit of area but also on the density of the distribution of the needles which act at the same time per unit of area. It has been found that in case of a given number of needle penetrations per unit of area a higher needle density will result in a more uniform surface of the nonwoven web than a lower needle density because in the latter case the penetrating operation will have to be repeated more often. On the other hand, the desire to increase the needle density of a needle board is opposed by the requirement to provide a minimum distance between adjacent holes in the perforated plate of the stripper and of any perforated plate of the backing member because that requirement calls for a predetermined minimum spacing of the axes of the holes and that minimum spacing is much larger than the smallest permissible spacing of the needle-receiving holes in the needle board. For this reason the perforated plate is formed with a common hole in association with each group of closely spaced needles and because the needles of each group are arranged in a longitudinal row the surface quality of the needled nonwoven web is desirably improved and the board length required for a given number of needles can decisively be reduced.

The lower limit of the distance which is permissible between the axes of adjacent needles of a group is determined by the requirement to hold the needles in the needle board and by the nature of the nonwoven web because it must still be ensured that the gap between the needles cannot become clogged with fibers which have been pulled out. Because the needles are arranged in longitudinal rows that risk of a clogging of the gaps between the needles can be avoided even in case of a smaller needle pitch. The needling operation will cause the fibers to be urged in a preferred direction which is transverse to the longitudinal rows so that particularly where a single row is associated with each hole the transverse spacing between the longitudinal rows of needles will be increased and the risk of clogging will thus considerably be reduced. Besides, the arrangement of needles in longitudinal rows will afford the advantage that the edges of the holes in the perforated plate can completely strip all needles whereas this could not be achieved at the needles of the intermediate one of three longitudinal rows. For this reason it is preferred in practice to associate each hole only with a single longitudinal row of needles. But in certain cases two or three rows of needles may be associated with each hole.

The distance between the axes of adjacent needles of each group should not be in excess of three-and-a-half needle shank diameters. This will result in an appreciable improvement of the surface quality of the needled nonwoven web. Needling conditions which are particularly desirable as regards a uniform surface of the nonwoven web will obviously be provided by a smaller spacing of the axes, which is desirably at least approximately as large as twice the shank diameter of the needle.

To desirably ensure a stripping action of the perforated plate on the needles of each group thereof, the distance between the edge of each hole and the needles of the associated group which are adjacent to said edge should be minimized. This requirement will particularly be met if the clearance between the edge of each hole and the needles which are adjacent to said edge is not in excess of twice the shank diameter of the needle and in that case each portion of said edge will be coaxial to the adjacent needle.

Because any regularity of the needle distribution may result in a surface structure of the needled nonwoven web, the transverse offset of the needles of each longitudinal row may be a random variable so that particularly high surface qualities can be achieved in case of such a random distribution of the needles.

In spite of a high needle density the various components, particularly the perforated plates, desirably have a high strength. This can be accomplished in that the needle groups are arranged in transverse rows, which are transverse to the direction of travel of the nonwoven web, and a plurality of transverse rows of groups of needles is succeeded in the direction of travel of the nonwoven web by a transverse zone which is free of needles so that the needle board and the perforated plate may be formed with continuous lands in said transverse zone and the strength of said components can thus be increased whereas the number of groups of needles may be as large as is required for a satisfactory needling operation. The width of each needlefree transverse zone may be selected in view of the strength which is required in a given case. In most applications a sufficiently high load capacity will be obtained if each needlefree transverse zone has a width that is at least as large as the width of one transverse row of needle groups.

DETAILED DESCRIPTION OF THE PREFERRED EMBODIMENT

Figure 1:
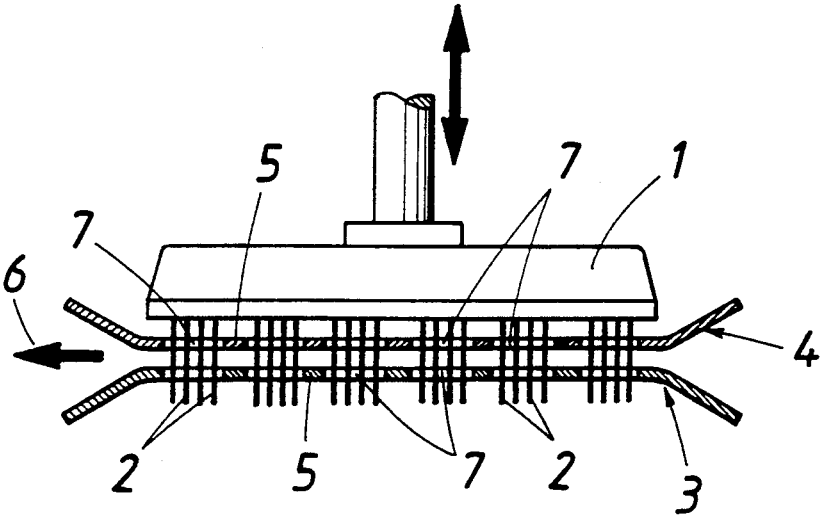
FIG. 1 is a schematic longitudinal sectional view showing an apparatus for needling a nonwoven web in accordance with the invention.
Figure 4:
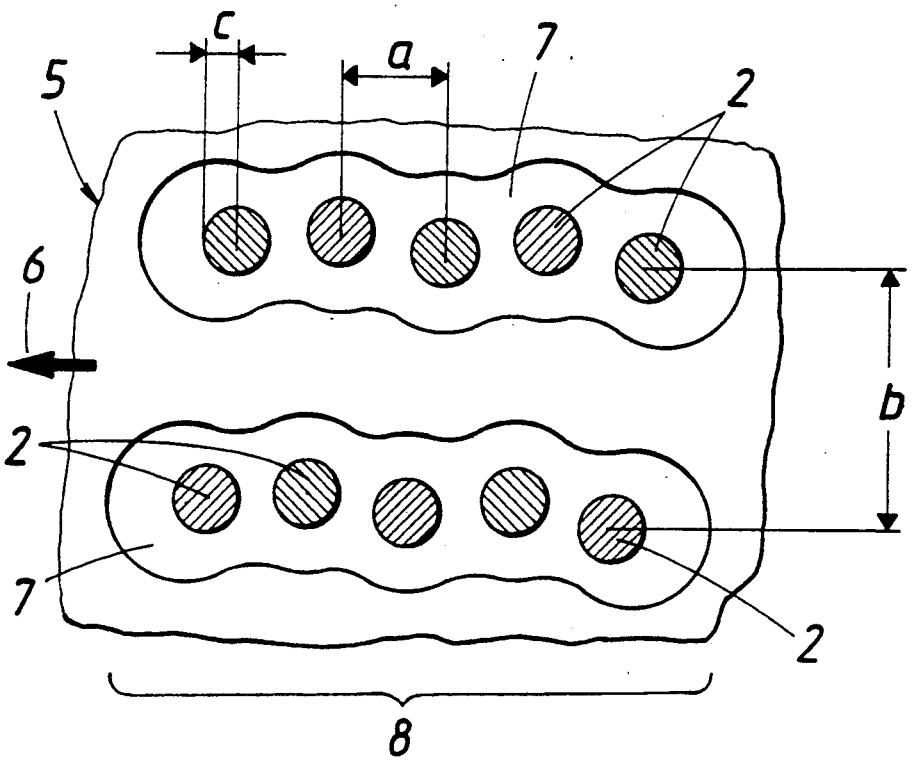
FIG. 4 is an enlarged top plan view showing a portion of the perforated plate adjacent to a single needle-receiving hole.
Figure 2:
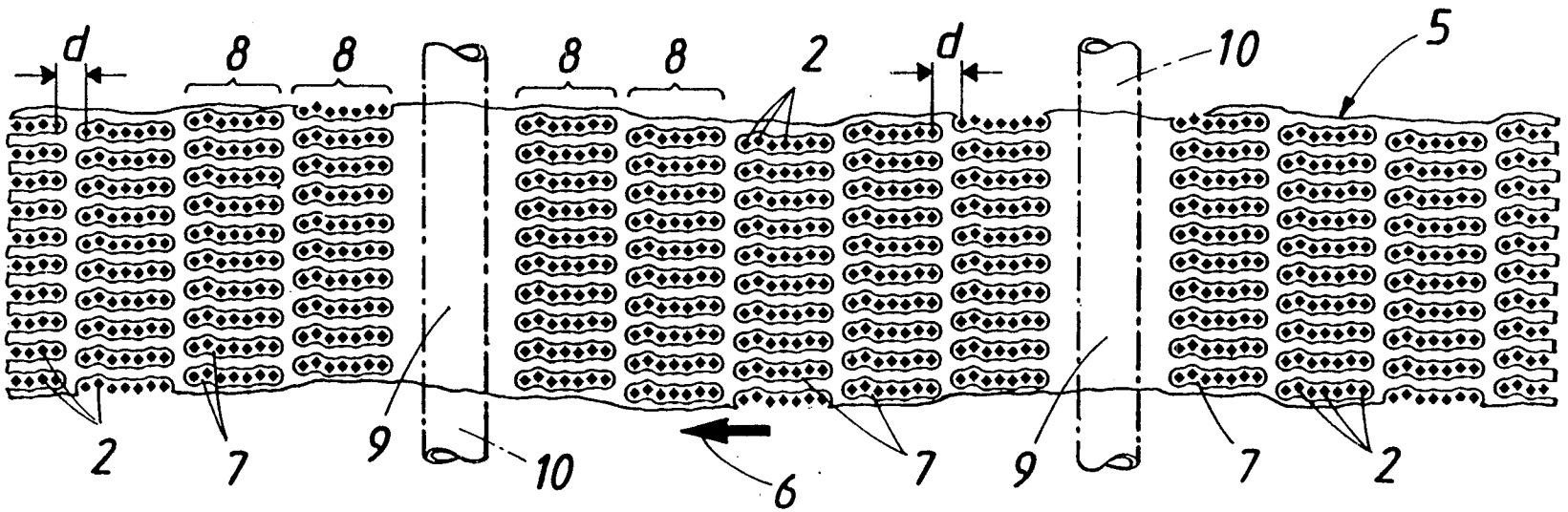
FIG. 2 is a fragmentary top plan view showing a portion of the perforated plate of the stripper of an apparatus for needling a web in accordance with the invention.
Figure 3:
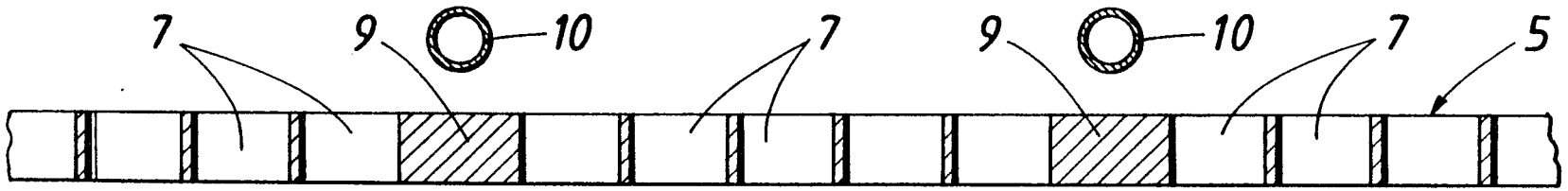
FIG. 3 is a longitudinal sectional view showing that perforated plate.

The invention is illustrated by way of example on the drawing.

In accordance with FIG. 1 the illustrated apparatus for needling a nonwoven web essentially consists of a needle board 1 provided with a multiplicity of needles 2, protruding from the needle board on one side thereof a backing member 3, which faces and is spaced from said one side of the needle board 1, and a stripper 4, which is disposed between the backing member 3 and the needle board 1 and like the backing member is constituted by a perforated plate 5. During the needling operation the nonwoven web is moved in the usual manner in a direction of travel indicated by the arrow 6 between the backing member 3 and the stripper 4.

The perforated plates 5 of the stripper 4 and of the backing member 3 are formed each with a multiplicity of holes 7 for receiving the needles 2. To permit the needles to be arranged with a density which is higher than the density which would correspond to the pitch of the holes 7, the needles 2 of the needle board 1 are combined in groups and a common hole 7 of the perforated plate 5 is associated with the needles of each group. As a result, the distance a between the axes of two adjacent needles of a group may be so small that it does not exceed three-and-a-half shank diameters of the needles 2 and this feature will have a considerable influence on the surface quality of the needled nonwoven web. From that aspect particularly desirable results will be produced if the distance a between the axes of adjacent needles 2 is at least approximately as large as twice the needle shank diameter. But a certain minimum distance between adjacent needles of a group will be required to avoid a clogging of the gap between the needles by fibers of the nonwoven web.

As is apparent from the drawing the needles 2 of each group are arranged in a longitudinal row generally extending in the direciton of travel 6 of the nonwoven web so that a conventional, larger needle spacing b will be obtained between said longitudinal rows, in which the needles are arranged with a high density. As a result, the fibers will mainly be urged into the spaces between the longitudinal rows of needles and the risk of a clogging of the gaps between the closely spaced needles of a group will be reduced.

In order to achieve the desired distribution of needle penetrations over the working width of the apparatus, the groups of needles and the needle-receiving holes 7 are arranged in transverse rows 8 and those transverse rows which succeed each other in the direction of travel 6 are staggered in the transverse direction. Besides, the needles 2 of each longitudinal row are offset transversely to the longitudinal row so that the nonwoven web will have a uniform surface particularly if that transverse offset of the needles 2 in each longitudinal row is a random variable because in that case surface structures which are due to regularities will be precluded. Besides, the longitudinal rows of needles within each transverse row 8 may be longitudinally staggered by different distances c. Irregularities in the surface structure may also be avoided in that adjacent transverse rows 8 are spaced different distances d apart so that the appearance of streaks in the surface of the nonwoven web will be avoided. The distances may also be a random variable.

To ensure that a small clearance will be left between the needles of each longitudinal row and the adjacent edge of the associated receiving hole and that such clearance will ensure an effective stripping and will allow for a deflection of the needles, the edge of the hole has adjacent to each needle 2 a configuration that is coaxial to such needle. The arrangement is such that the clearance between each needle and the adjacent portion of the edge of the hole is not in excess of the shank diameter of the needle. As is apparent the small clearance between the needle-receiving holes 7 which is desired for the needling operation may considerably restrict the load capacity of the perforated plate 5. To avoid such a restriction a plurality of transverse rows 8 of receiving holes and needle groups are succeeded by a transverse zone 9, which is free of needles and holes and which continuously extends transversely to the direction of travel of the web throughout the length of the needle board 1 or of the perforated plate 5 so that the perforated plate 5 comprises lands, by which its strength is increased. The perforated plate may be provided with additional reinforcements adjacent to said lands. Besides, the passages left between the needles 2 at the transverse zones 9 which extend in the longitudinal direciton of the board may desirably be used to accommodate needle-cleaning means, such as blowing and/or suction lines 10.

I claim:

1. An apparatus for needling a nonwoven web as it is moved in a direction of travel, which comprises (a) a needle board carrying at least one row of a plurality of needle groups arranged successively in the direction of travel, each needle group consisting of (1) a plurality of needles having shanks projecting from the needle board on one side thereof in the direction of the longitudinal shank axes, the needles being arrayed in the direction of travel and being offset from each other transversely to the direction of travel, (b) a backing member facing the one needle board side and spaced therefrom, the backing member being engageable by the nonwoven web as it is moved in the direction of travel between the needle board and the backing member, and (c) a perforated stripper plate extending between the needle board and the backing member, the stripper plate defining a plurality of holes arranged successively in the direction of travel, a respective one of said holes registering with a respective one of said needle groups, (d) the needle board being reciprocable toward and away from the backing member for moving the needle groups through the registering holes in the perforated stripper plate.

2. The needling apparatus of claim 1, wherein the spacing between the longitudinal shank axes of adjacent ones of the needles in each group does not exceed three-and-a-half diameters of the needle shanks.

3. The needling apparatus of claim 2, wherein the spacing between the longitudinal shank axes of adjacent ones of the needles in each group is approximately twice the diameter of the needle shanks.

4. The needling apparatus of claim 1, wherein each of said holes has an edge defining a clearance with the shanks of the needles adjacent to the edge when the needle groups are moved through the registering holes, the clearance being not in excess of twice the diameter of the needle shanks.

5. The needling apparatus of claim 1, wherein the needles are transversely offset from each other to an extent which is a random variable.

6. The needling apparatus of claim 1, wherein the row comprises sets of said plurality of needle groups arranged successively in the direction of travel, successive sets of said needle groups being separated in the direction of travel by zones free of needles.

7. The needling apparatus of claim 6, wherein the backing member is a perforated plate defining a plurality of holes arranged successively in the direction of travel, a respective one of said holes registering with a respective one of said needle groups and said holes in the perforated stripper plate, the needle board being reciprocable toward and away from the backing member for moving the needle groups through the registering holes in the perforated stripper and backing member plates.

* * * * *